US010576390B2

(12) United States Patent
Rosenbaum

(10) Patent No.: US 10,576,390 B2
(45) Date of Patent: Mar. 3, 2020

(54) PLUSH TOY WITH INNER BLADDER THAT CONTAINS MATERIALS SUCH AS LIQUIDS, GELS, POWDERS OR GASSES

(71) Applicant: Barry Rosenbaum, Boca Raton, FL (US)

(72) Inventor: Barry Rosenbaum, Boca Raton, FL (US)

( * ) Notice: Subject to any disclaimer, the term of this patent is extended or adjusted under 35 U.S.C. 154(b) by 0 days.

(21) Appl. No.: 16/244,318

(22) Filed: Jan. 10, 2019

(65) Prior Publication Data

US 2019/0209934 A1 Jul. 11, 2019

Related U.S. Application Data

(60) Provisional application No. 62/615,617, filed on Jan. 10, 2018.

(51) Int. Cl.

| | |
|---|---|
| ***A63H 3/02*** | (2006.01) |
| ***A63H 3/00*** | (2006.01) |
| *A63H 9/00* | (2006.01) |

(52) U.S. Cl.

CPC ..... *A63H 3/02* (2013.01); *A63H 3/001* (2013.01); *A63H 9/00* (2013.01)

(58) Field of Classification Search

CPC . A63H 3/00; A63H 3/02; A63H 3/005; A63H 3/36; A63H 3/52; A63B 21/00189; A63B 43/002

USPC ..... 446/221, 226, 267, 369, 385, 183

See application file for complete search history.

(56) References Cited

U.S. PATENT DOCUMENTS

| | | | | |
|---|---|---|---|---|
| 4,952,190 | A * | 8/1990 | Tarnoff | A63B 21/00189 446/267 |
| 5,921,840 | A * | 7/1999 | Diresta | A63H 3/00 446/198 |
| 6,126,510 | A * | 10/2000 | Weiss, Jr. | A63B 43/002 446/226 |
| 7,384,324 | B2 | 6/2008 | Fullmer | |
| 2011/0070802 | A1 * | 3/2011 | Li | A63H 3/005 446/72 |

* cited by examiner

*Primary Examiner* — Kien T Nguyen

(74) *Attorney, Agent, or Firm* — Brooks Kushman P.C.

(57) ABSTRACT

A plush toy having a spherical fabric shell defining a substantially enclosed cavity with an opening forming a mouth. A normally spherical elastic bladder filled with fluid is located within the enclosed cavity. When the spherical fabric shell is squeezed by a user, the elastic bladder elastically deforms forming a generally spherical bubble projecting out of the mouth opening. When the spherical fabric shell is released the bladder retracts into the fabric shell.

11 Claims, 5 Drawing Sheets

PLUSH TOY WITH INNER BLADDER THAT CONTAINS MATERIALS SUCH AS LIQUIDS, GELS, POWDERS OR GASSES

CROSS-REFERENCE TO RELATED APPLICATIONS

This application claims the benefit of U.S. provisional application Ser. No. 62/615,617 filed Jan. 10, 2018, the disclosure of which is hereby incorporated in its entirety by reference herein.

TECHNICAL FIELD

This application relates to plush toys and in particular to squeezable squishy plush toys.

BACKGROUND

Plush toys contain soft materials, with the inner materials contained by the outside plush material cover. The inner stuffing can easily escape with an opening in the plush material. Further, the stuffing material of the plush toy is limited to materials such as synthetic fiber batting, cotton, straw, wool, plastic pellets, beans and foam.

Other plush toys are limited as to the stuffing to materials such as synthetic fiber batting, cotton, straw, wool, plastic pellets, beans and foam.

SUMMARY

This invention allows a plush toy to contain various materials, that move and change form during use, thereby creating different play patterns.

A plush toy is preferably provided having a spherical fabric shell defining plush exterior and a substantially enclosed interior cavity with an opening forming a mouth. A normally spherical elastic bladder filled with fluid and the bladder is located within the enclosed cavity. When the spherical fabric shell is squeezed by a user, the elastic bladder elastically deforms forming a generally spherical bubble projecting out of the mouth opening. When the spherical fabric shell is released the bladder retracts into the fabric shell.

In a preferred embodiment the elastic bladder is formed a transparent elastomer, such as latex, and filled with a liquid preferably water. Little or no air is entrapped within the bladder rendering the bladder contents, a liquid, substantially incompressible. The liquid may contain reflective particles that freely float about the liquid when the elastic bladder is deformed forming a bubble projecting out of the mouth opening. The bubble preferably can achieve a diameter $D_b$ which over 2.0 times the diameter of the mouth opening $D_m$. The bladder is its free state within the enclosed interior cavity has a diameter D where $D_b$ is preferably greater than D/2.

The plush toy may further include a flexible nose flap affixed to the spherical fabric shell adjacent the mouth. The nose flap at least partially covers the mouth opening and deflects out of the way when the spherical fabric shell is squeezed by a user forming a bubble projecting out of the mouth opening. While this is a preferred structure, a single layer fabric shell can be used to practice the invention.

The spherical fabric shell of the plush toy is preferably provided with a resealable opening enabling the elastic bladder to be installed or removed. in the illustrated embodiment the opening is releasably closed by a flap having a hook and loop closure such as Velcro®.

The spherical fabric shell of the plush toy is preferably formed of an inner shell layer and on outer plush layer. The two layers are sewn together to form the mouth using a hidden hemmed seam which surrounds the mouth opening.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

As stated above, plush toys contain soft materials, with the inner materials contained by the outside plush material cover. The inner stuffing can easily escape with an opening in the plush material. Further, the stuffing material of the plush toy is limited to materials such as synthetic fiber batting, cotton, straw, wool, plastic pellets, beans and foam. The invention claimed here solves this problem.

This invention allows plush toys to contain various forms of liquid, gel, powder and gaseous materials as the inner material is fully contained in a nonporous sealed bladder. The plush material cover can be designed with openings to allow the inner bladder to appear when compressed and expanded.

The claimed invention differs from what currently exists. This invention allows plush toys to contain various materials such as liquids, gels, powders or gasses. The outer plush material may contain one or several openings to manipulate the bladder to become exposed.

This invention is an improvement on what currently exists. This invention allows plush toys to contain various materials such as liquids, gels, powders or gasses. The outer plush material may contain one or several openings to manipulate the bladder to become exposed.

By limiting the stuffing material, the properties of a plush toy cannot be maximized. An opening in the outer plush material will allow the stuffing to escape.

This invention allows a plush toy to contain various materials thereby creating a different play pattern.

The exemplary version of plush toy includes:

1. Outer cover made of various materials including cloth, terrycloth and plush.
2. Inner bladder made of various nonporous elastic materials.
3. Material inside inner bladder, such as various types of liquids, gels, powders and/or gasses.
4. An opening is formed in the outer cover forming a mouth.

Relationship Between the Components:

#1 (outer cover) conceals #2 inner bladder, which contains #3, a material such as various types of liquids, gels, powders and/or gasses. An opening or several openings, #4. In the outer cover allows the inner bladder to be revealed.

How the Invention Works:

The bladder containing a liquid, gel, powder and/or gas is inserted in a plush outer cover. The plush cover conceals the inner bladder. The inner bladder has substantially the same size and configuration of the outer cover whereby upon pressure exerted, the inner bladder expands and contracts. Based on the internal bladder, the plush toy is malleable and may be squeezed and manipulated. The outer plush material may contain one or several openings to manipulate the bladder to allow it to become exposed.

How to Make the Invention:

Insert a material such as a liquid, gel, powder and/or gas into a nonporous bladder. Insert the bladder into the outer cover.

A nonporous bladder is necessary to contain a liquid, gel, powder and/or gas. An outer cover made of various materials including cloth, terrycloth and plush is necessary to conceal the bladder. One or more openings in the outer cover are optional.

How to Use the Invention:

To use this invention, one would simply squeeze the plush toy to extend the bladder through the mouth opening to form a bubble. Releasing the toy causes the bubble to retract within the plush toy's fabric shell.

Additionally: This invention can be used as a conventional ball or pillow.

DETAILED DESCRIPTION

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

Figure 1:
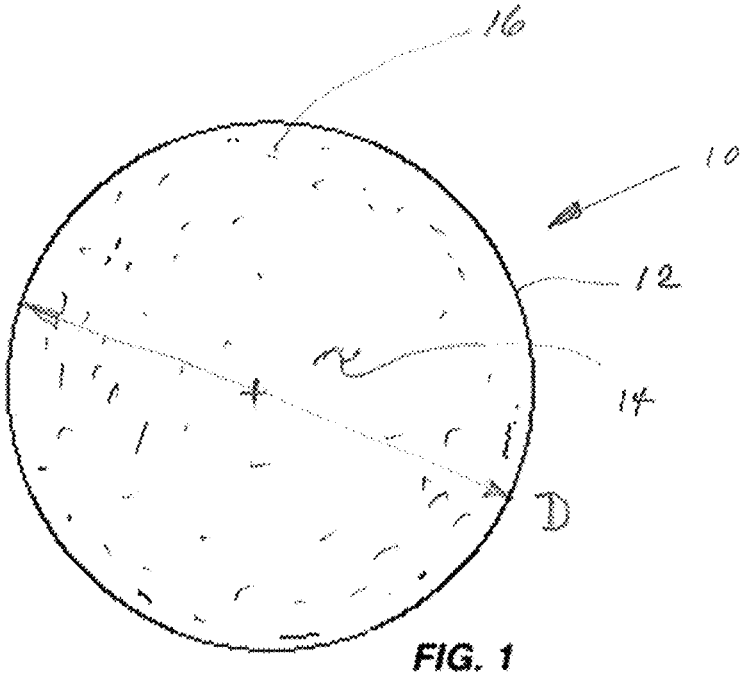
FIG. 1 is a side view of a fluid-filled bladder.

A normally spherical elastic bladder 10 is illustrated in FIG. 1. This bladder 10 has an elastic bladder skin 12 which is preferably formed of a transparent latex material, however other elastic polymers may be used, such as neoprene or nitrile. The elastic bladder 10 is filled with a fluid 14, preferably a liquid such as water. Water is the preferred, since in the event of a bladder rupture the resulting mess is easy to clean up. The elastic bladder or the liquid container therein may be provided with a color for aesthetic purposes. In the preferred embodiment illustrated, the fluid contains a plurality of particles 16, which freely float within the fluid in a snow-globe fashion. Preferably the particles 16 have a specific gravity close to, ±5% of the liquid so that the particles can remain in suspension for a long time when the bladder is shaken or deformed. Bladder 10 in the free unsqueezed state takes on a spherical form as illustrated in FIG. 1, having a diameter D.

Figure 2:
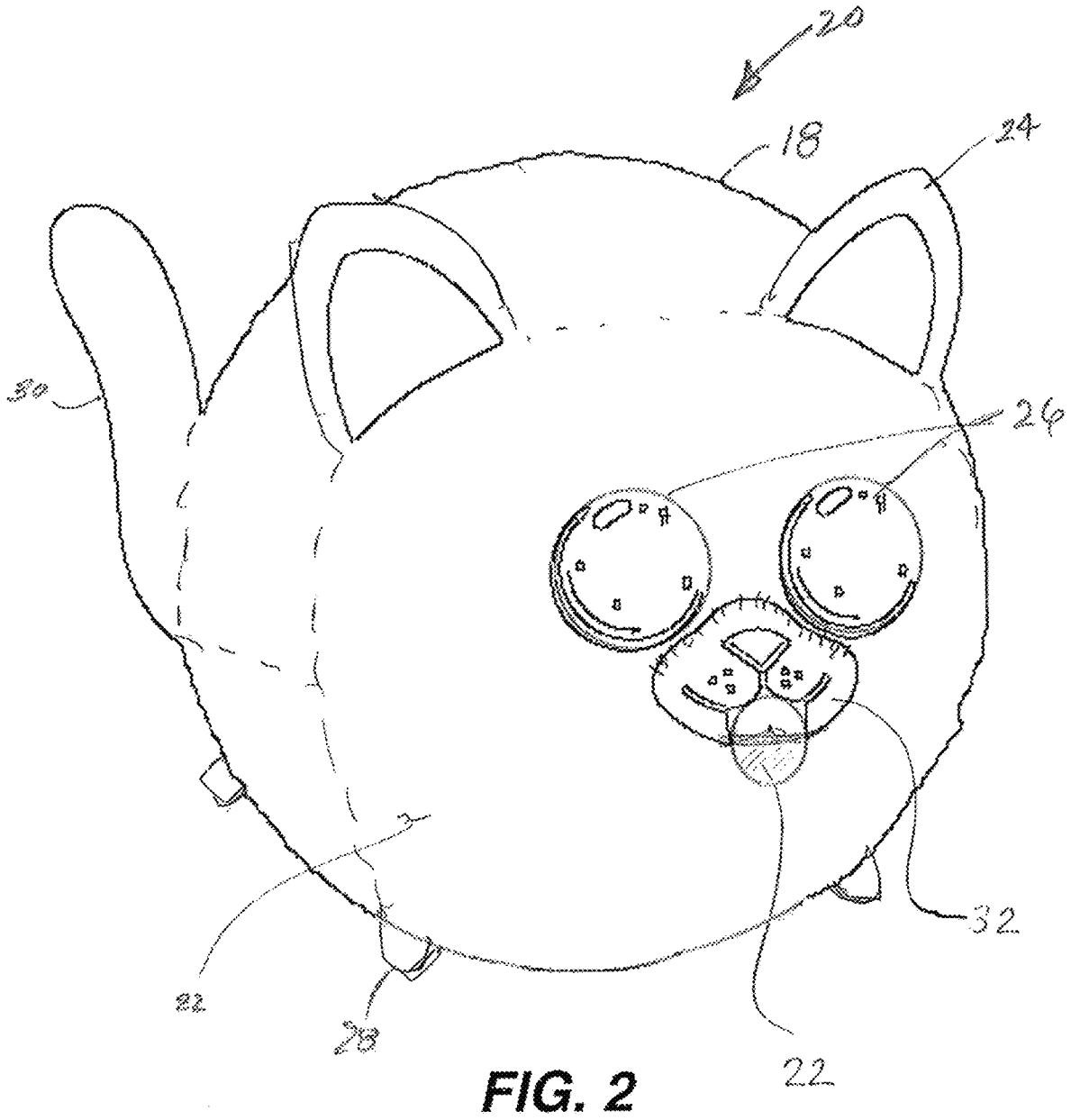
FIG. 2 is a perspective view of an embodiment of the plush toy.

Filled bladder 10 fits within a spherical fabric shell 18 of plush toy 20 shown in FIG. 2. The spherical fabric shell 18 defines a substantially enclosed interior cavity, also having a diameter D. The fabric shell 18 has a mouth opening 22 which extends through the fabric shell in communication with the enclosed interior cavity. The exterior surface of the spherical fabric shell 18 can be decorated in the form of a number of different toys. Along the lines of an animal theme, the FIG. 2 plush toy 20 has cat like features: a pair of ears 24, a pair of eyes 26, feet 28 and a tail 30. A nose flap 32 is affixed to the fabric shell 18 and partially overlaps mouth 22. The nose flap 32 is stitched to the fabric shell 18 along its upper marginal edge to allow the nose flap to be able to flex, exposing the mouth opening 22.

Figure 3:
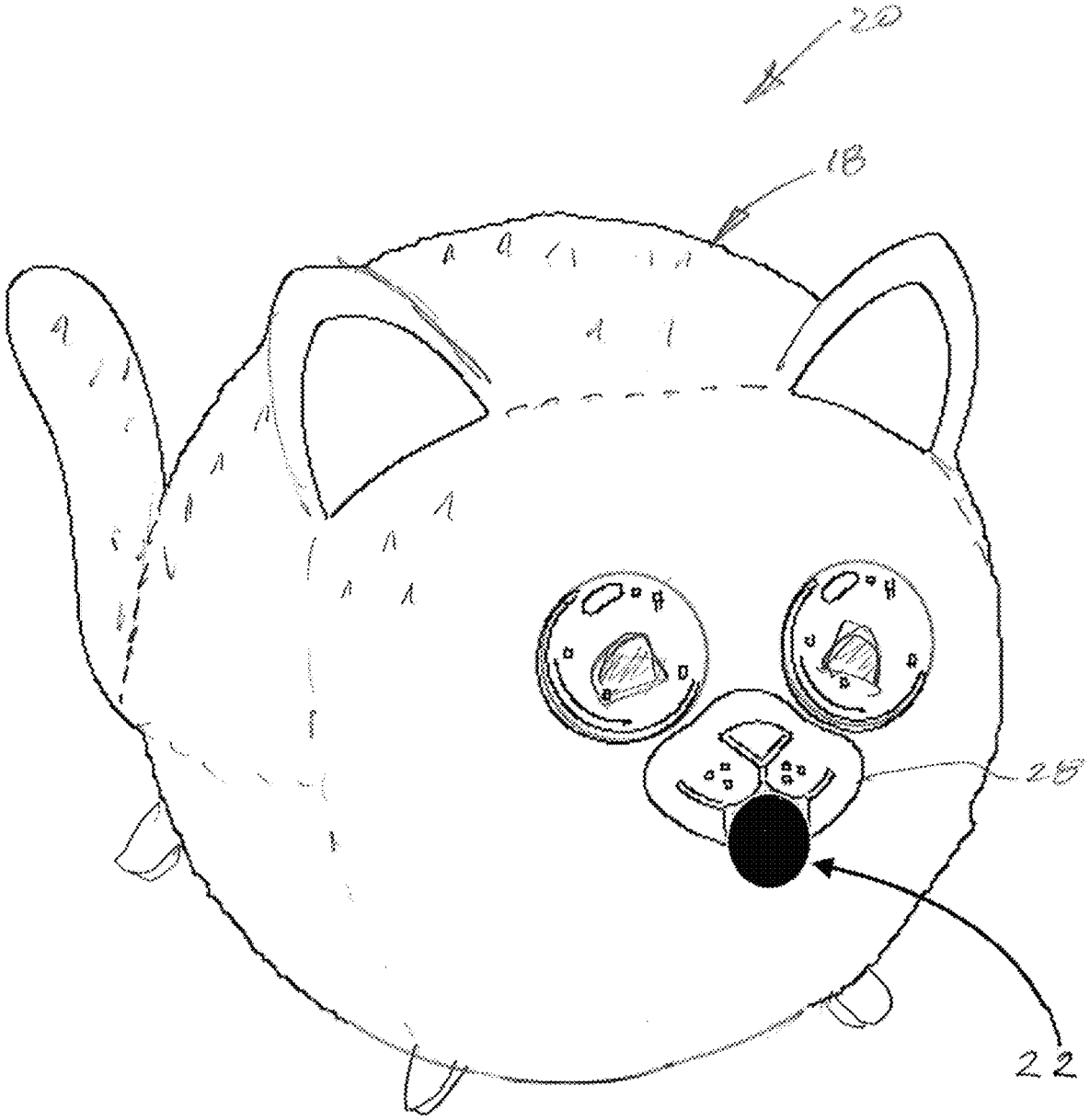
FIG. 3 is an embodiment of the plush toy of FIG. 2 with a portion of the nose-flap removed to expose the mouth opening.

FIG. 3 illustrates the plush toy 20 with a portion of the nose flap 32 removed, exposing the mouth opening 22. The mouth opening is preferably circular and less than one inch in diameter, preferably about 0.7 inches in diameter. The user playing with the plush toy 20 may squeeze the body of the plush toy causing the fluid within the bladder to pressurize due to the fluids incompressible nature causing the bladder to extend outward through the mouth opening, forming a bubble shape form.

Figure 4:
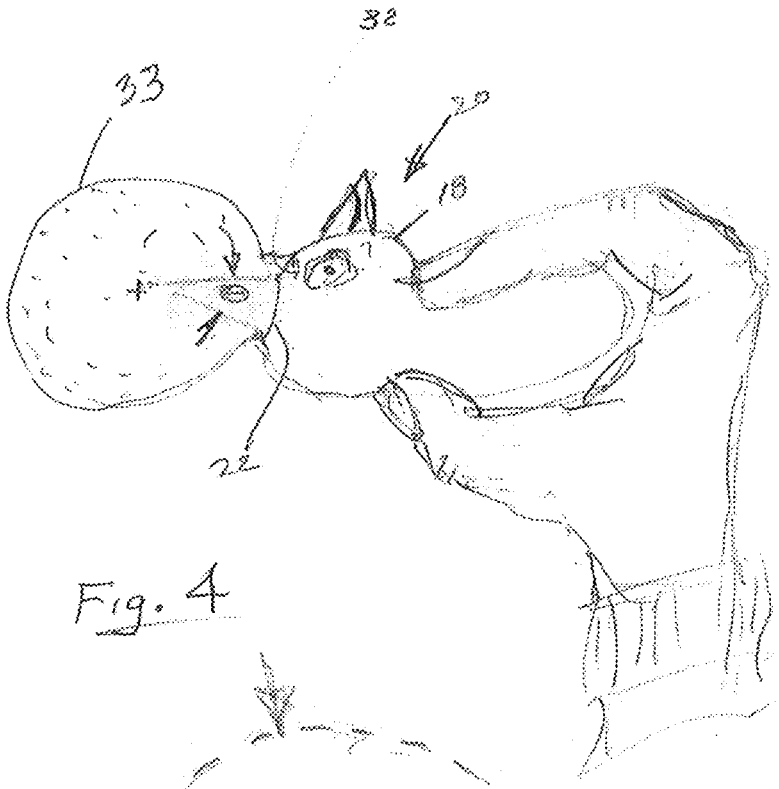
FIG. 4 illustrates the plush toy being squeezed by the hand of a user causing a bubble to be projected from the plush toys' mouth.

Plush toy 20 in the squeezed state is illustrated in FIG. 4. As the user squeezes the spherical fabric shell 18 of plush toy 20 as illustrated, a portion of the bladder forms a bubble 33 which extends out of the mouth opening 22 as shown. The more the shell is squeezed, the more liquid is displaced, and the larger bubble 33 becomes. The mouth opening has a diameter $D_m$. The bubble 33 has a normal diameter of $D_b$ when squeezed by a user with one hand. Preferably $D_b$ is capable of exceeding 2 times $D_m$ when the spherical plastic shell is squeezed with one hand between the user's finger and thumb. The mouth opening relative to the bubble size is further quantifiable by angle θ shown in FIG. 4, where θ is less than 90° and preferably less than 60°.

Figure 5:
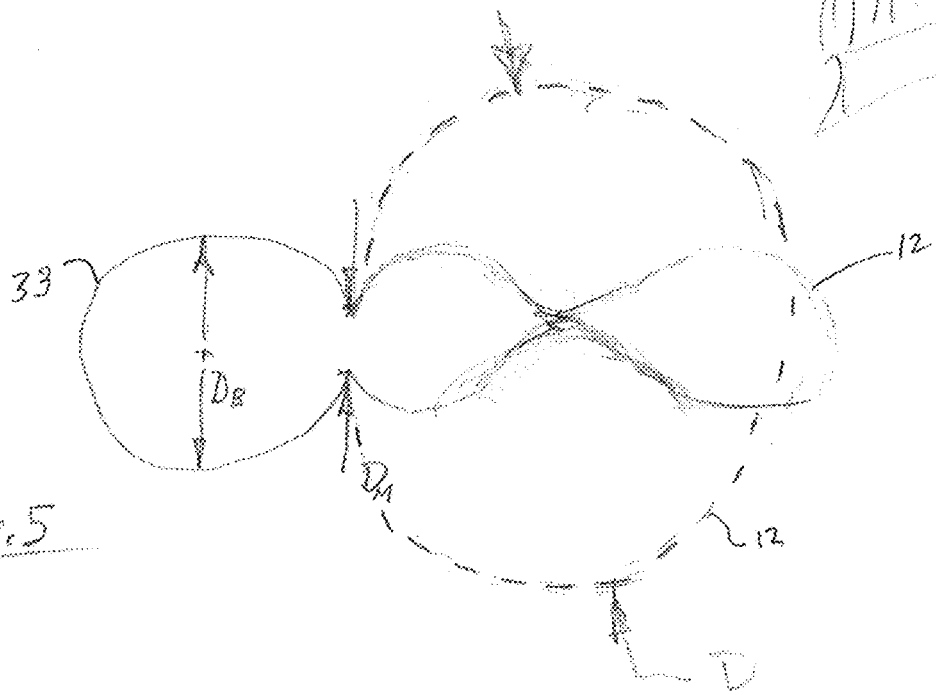
FIG. 5 is a side-elevational view of the bladder in an unsqueezed state in phantom outline, and the fully squeezed state in which a bubble is formed.

The forming of bubble 33 is further illustrated in FIG. 5. When the elastic bladder 12 is in the unsqueezed spherical state, it has a diameter D represented by the dotted outline. When squeezed in one hand, between the user's fingers and thumb, the bladder takes on a flattened shape with a portion of the bladder extending through the mouth opening $D_m$, forming bubble 33, having a diameter of $D_b$. $D_b$ is preferably over two times the diameter of the mouth $D_m$. When a bladder is squeezed the bubble diameter $D_b$ can be formed preferably having a diameter greater than D/2, i.e. greater than ½ of the free bladder diameter D.

Figure 6:
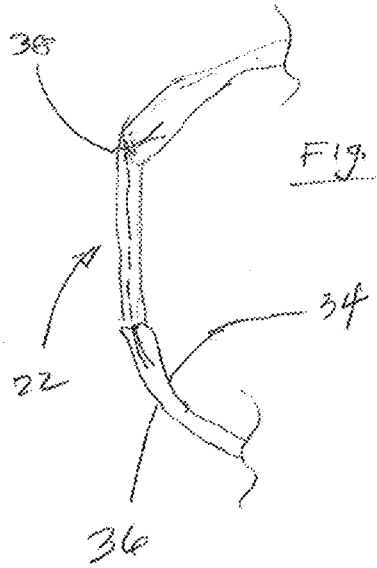
FIG. 6 is a cross-sectional side-elevational view of a portion of the spherical fabric shell having the mouth opening.

Fabric shell 18 is preferably formed of two layers of fabric. An inner layer 34 and an outer plush layer 36. The inner and outer fabric layers 34 and 36 are sewn together with a hidden seam 38, illustrated in FIG. 6. This structure forms a simple clean mouth opening 22 through which the bladder 12 may extend when the fabric shell is squeezed by a user.

Figure 7:
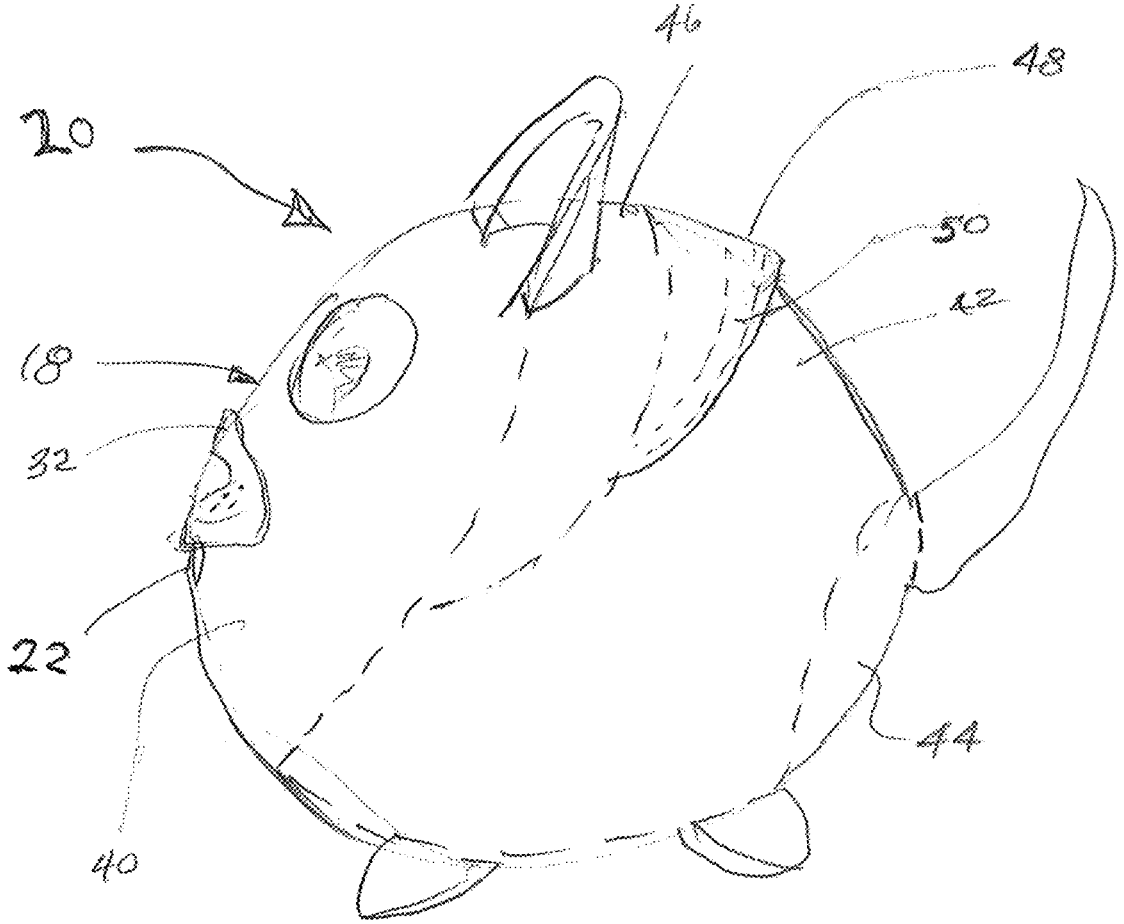
FIG. 7 is a side-elevational view of the plush toy of FIG. 2 in the unsqueezed state illustrating the flap which closes a resealable opening in the shell.

FIG. 7 illustrates a side-elevation of the exemplary plush toy 20. The spherical fabric shell 18 is made up of a series of panels sewn together, base panel 40, main panel 42, rear panel 44 and top panel 46. An opening is formed between main panel 46 and 42 which is a sufficient size to enable the filled bladder 10 to be installed or removed from the interior sphere. This opening in the enclosed cavity is resealably closed by a flap 48 connected to top panel 46. Flap 48 is releasably connected to the main panel 42 by a strip of hook and loop fasteners 50 such as VELCRO. Of course, a zipper or other releasable seam closure may be used. The resealable flap 48 enables the flexible bladder 10 to be removed from the spherical fabric shell 18 so that the shell can be washed when dirty or if the bladder replaced if ruptured.

Of course, a variety of other animal, human or other mythical character decorations can be applied to the exterior surface of the spherical fabric shell. While a spherical bladder and spherical fabric shell are shown in the illustrated embodiment, the bladder shape may deviate slightly from spherical taking on an elliptical shape for an elongated animal body or a flattened toroidal shape to form a body of a tropical fish. However, a general spherical shape is preferred as it allows for the largest bubble size which is achieved when squeezing the toy with one hand.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A toy comprising:

a spherical fabric shell defining a substantially enclosed cavity, the fabric shell having an opening forming a mouth of the plush toy extending through and in communication with the enclosed cavity;

a normally spherical elastic bladder filled with fluid, with the elastic bladder located within and filling the enclosed cavity; and a flexible nose flap affixed to the spherical fabric shell adjacent the mouth;

wherein the nose flap at least partially covers the mouth opening and deflects out of the way when the spherical fabric shell is squeezed by a user and is directly visible by the user.

2. The plush toy of claim 1, wherein the spherical fabric shell is provided with a resealable opening enabling the elastic bladder to be installed or removed.

3. The plush toy of claim 2, wherein the resealable opening is provided with a flap having a hook and loop closure.

4. The plush toy of claim 2, wherein, when the spherical fabric shell is squeezed by a user, the elastic bladder elastically deforms projecting out of the mouth opening forming a generally spherical bubble tangent to the mouth, the spherical bubble having a diameter $D_b$ which is over 2.0 times the diameter of the mouth $D_m$.

5. The plush toy of claim 4, wherein the spherical fabric shell is formed of an inner shell layer and on outer plush layer which are sew together in a hidden hemmed seam surrounding the mouth opening.

6. The plush toy of claim 4, wherein diameter $D_b$ is over 2.0 times the diameter of the mouth $D_m$.

7. A plush toy comprising:

a spherical fabric shell defining a substantially enclosed cavity, the fabric shell having an opening forming a circular mouth opening of the plush toy having a diameter $D_m$ extending through and in communication with the enclosed cavity;

a normally spherical elastic bladder filled with liquid, with the elastic bladder located within and filling the enclosed cavity and having a diameter D; and a flexible nose flap affixed to the spherical fabric shell adjacent the mouth, wherein the nose flap at least partially covers the mouth opening and deflects out of the way when the spherical fabric shell is squeezed by a user;

wherein, when the spherical fabric shell is squeezed by a user, the elastic bladder elastically deforms projecting out of the mouth opening forming a generally spherical bubble which is directly visible by the user and is tangent to the mouth, the spherical bubble capable of having a diameter $D_b$ which is greater then D/2, when the spherical fabric shell is released the bladder retracts into the fabric shell.

8. The plush toy of claim 7, wherein the liquid contains a plurality of reflective particles which float about the spherical bubble when the fabric shell is squeezed, and the bubble formed.

9. The plush toy of claim 7, wherein the spherical fabric shell is provided with a resealable opening enabling the elastic bladder to be installed or removed.

10. The plush toy of claim 9, wherein the resealable opening is provided with a flap having a hook and loop closure.

11. The plush toy of claim 7, wherein the bladder is formed of transparent plastic and the liquid stored therein contains a plurality of reflective particles which float about the spherical bubble when the shell is squeezed forming the bubble.

* * * * *